United States Patent [19]

Diamandis

[11] Patent Number: 4,815,744

[45] Date of Patent: Mar. 28, 1989

[54] AUTOMATIC GOLF BALL TEE ASSEMBLY

[76] Inventor: Manolis Diamandis, Box 36, Site 12, R.R. #4,, Calgary, Alberta, Canada, T2M 4L4

[21] Appl. No.: 94,308

[22] Filed: Sep. 4, 1987

[51] Int. Cl.[4] ..... A63B 57/00

[52] U.S. Cl. ..... 273/201; 124/51 R

[58] Field of Search ..... 273/201, 33, 179 B, 273/202, 182 R; 124/50, 51 R

[56] References Cited

U.S. PATENT DOCUMENTS

| | | | |
|---|---|---|---|
| 1,779,541 | 10/1930 | Haynes | 273/201 |
| 2,198,968 | 4/1940 | Jewett | 273/201 |
| 2,530,698 | 11/1950 | Hogeberg | 273/201 |
| 2,675,237 | 4/1954 | Willcox | 273/201 |
| 2,696,985 | 12/1954 | Hogeberg | 273/201 |
| 2,838,313 | 6/1958 | Mozel | 273/201 |
| 3,298,694 | 1/1967 | Turneau et al. | 273/201 |
| 3,738,663 | 6/1973 | Gentiluomo | 273/201 |
| 3,778,067 | 12/1973 | Gentiluomo | 273/201 |
| 4,017,087 | 4/1977 | Bruno | 273/201 |
| 4,355,811 | 10/1982 | Williams, Sr. | 273/201 |

FOREIGN PATENT DOCUMENTS

| | | | |
|---|---|---|---|
| 10871 | 12/1927 | Australia | 273/201 |

*Primary Examiner*—Richard C. Pinkham
*Assistant Examiner*—Theatrice Brown
*Attorney, Agent, or Firm*—Ciotti & Murashige, Irell & Manella

[57] ABSTRACT

The device includes a gravity ball feed to an elevator component having a tee on the upper end thereof. The raising of the tee is operated electrically and the lowering thereof is by gravity. The electric motor turns a gear engaging a rack on the elevator component and a player actuated switch causes the elevator component with a ball on the tee to rise into the desired position. When fully raised, a further, internal switch actuated by the gear stops the motor while the golfer strikes the ball. The first switch is again actuated by the player and the gear having a segment of the teeth removed, disengages from the rack which falls by gravity to pick up another ball whereupon the teeth once again engage the rack and re-commence the tee raising sequence.

13 Claims, 2 Drawing Sheets

AUTOMATIC GOLF BALL TEE ASSEMBLY

BACKGROUND OF THE INVENTION

This invention relates to new and useful improvements in automatic golf ball teeing apparatus particular suitable for use in driving ranges, practice tees and the like.

Many such devices exist but they are normally gravity operated or incorporate a mechanical leverage system and are not particularly satisfactory in operation.

PRIOR ART

Prior Art known to applicant include the following U.S. Patents:

U.S. Pat. No. 2,530,698, B. A. Hogeberg, Nov. 21, 1950.

This utilizes a beam of light intercepted by the ball on the tee which, when the ball is struck allows the light to pass to a photo-electric cell which energizes the teeing cycle in which the teeing member is depressed, a gate operates to effect delivery of another ball and the tee member carrying the ball is raised into position. A cradle type rocking gate controls the movement of the golf balls from the supply chute in a positive manner thus eliminating jamming.

U.S. Pat. No. 2,675,237, L. J. Willcox, Apr. 13, 1954. This shows a pivoted arm carrying the golf ball from a reservoir to the tee.

U.S. Pat. No. 2,696,985, B. A. Hogeberg, Dec. 14, 1954. This shows a solenoid operated plunger arrangement with the tee on the upper end thereof.

U.S. Pat. No. 2,838,313, J. Mozel, June 10, 1958. This patent utilizes a cam and cross-head system together with a plunger having the golf tee affixed to the upper end thereof normally held in a raised position by action of a connecting rod and spring.

U.S. Pat. No. 4,017,087, P. Bruno, Apr. 12, 1977, utilizes a piston moving upwardly and downwardly in a cylinder situated below ground level and having a tee on the upper end thereof.

U.S. Pat. No. 4,355,811, L. E. Williams, mechanically raises and lowers the tee by means of a double oppositely threaded shaft and poll thereon. The shaft is rotated thus raising and lowering the poll to which the tee is attached.

The present invention overcomes disadvantages inherent in existing equipment by providing an automatic teeing device which includes an elevator component raised by a source of power such as an electric motor and having a tee on the upper end thereof upon which a golf ball is automatically positioned when the elevator component is in its lowermost position.

One aspect of the invention is to provide a golf ball teeing apparatus comprising in combination an enclosure, a gravity fed golf ball supply chute leading into said enclosure, a vertically movable ball elevator component, guide means for said elevator component, a tee mounted in the upper end thereof, means to move said elevator component from the lower ball loading position to a raised tee position and vice versa, said chute discharging a ball by gravity through said guide means and onto said tee when said elevator component is in said lower ball loading position, the source of power to raise said elevator component, and means operatively connected between said source of power and said elevator component, said elevator component returning to the lower position by gravity.

A further advantage of the invention is that it can be completely enclosed and situated below ground with only a ball feeding hopper being visible and the elevator component, when it is in the uppermost position together with a tee carrying a golf ball.

Another advantage of the invention is the incorporation of first and second switch means together with a gear in which a segment of the teeth have been removed. Actuation of a normally open first switch by the player causes the elevator component to raise with a ball engaged upon the tee. When in the uppermost position, a normally closed second switch means in parallel with the first switch means and internally situated, automatically stops the elevator component so that the player may then address the ball in the normal manner.

After the ball has been struck, the first switch means is again actuated by the player whereupon the segment of the gear with the teeth removed, operatively disengages the gear from the elevator component which falls by gravity, and a further ball is deposited upon the tee. When the segment with the teeth removed has rotated sufficiently, the teeth of the gear once again engage the rack and raise it to the uppermost position with the ball thereon.

Another advantage of the invention is to provide a device of the character herewithin described which is simple in construction, economical in operation and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
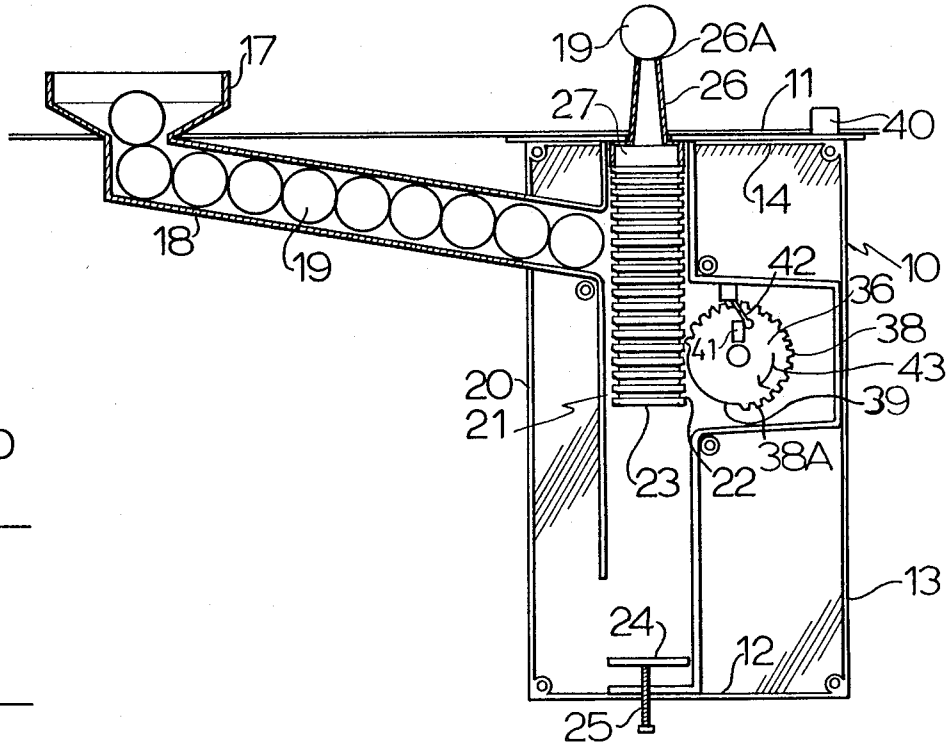
FIG. 1 is a side elevation of the device with the cover plate removed for clarity.
Figure 3:
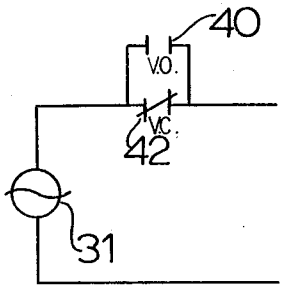
FIG. 3 is a schematic diagram of the electrical portion of the device.
Figure 2:
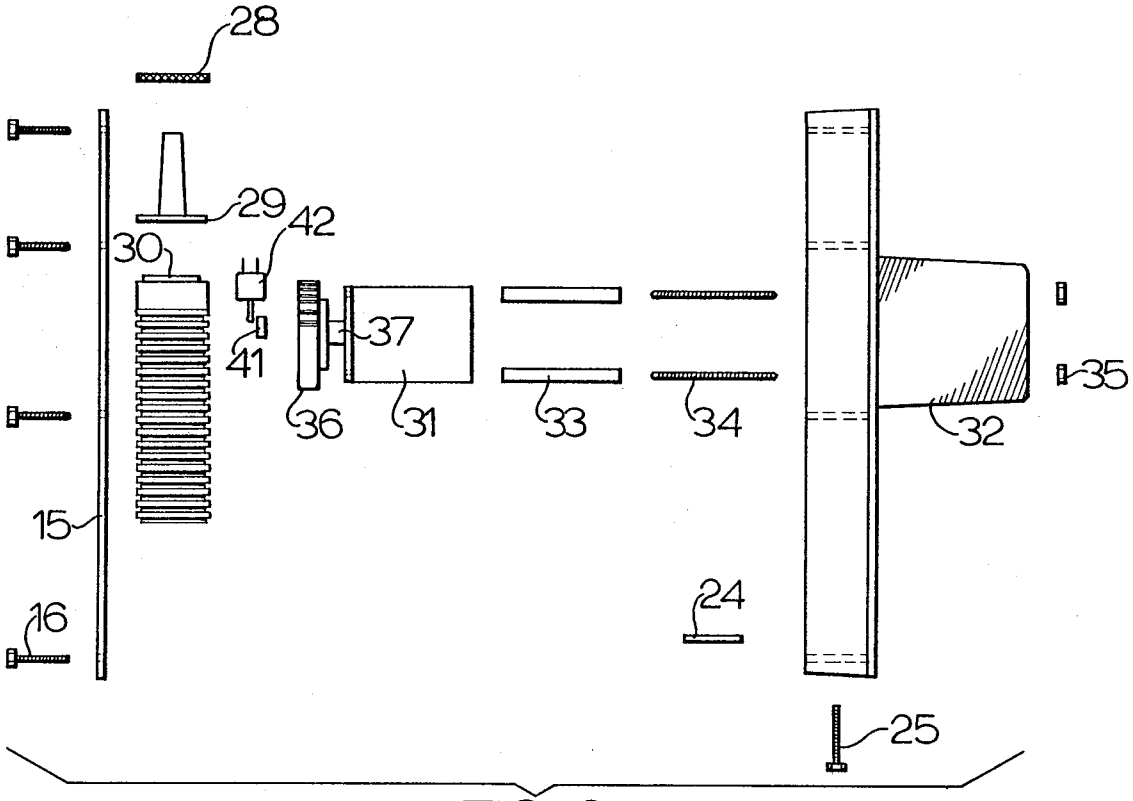
FIG. 2 is an exploded view of the assembly taken at right angles from FIG. 1.

Proceeding therefore to describe the invention in detail, reference character 10 illustrates an enclosure which is normally situated below a teeing surface which may take the form of artificial grass cloth 11 or the like.

The enclosure includes a base 12, end walls 13, an upper plate 14, side plate 15 and a removable side plate 15A with the plate 15A being detachably secured to the enclosure by means of bolts 16.

Situated on one side of the teeing surface 11 is a ball hopper 17 leading to a ball chute 18 which inclines downwardly to the enclosure 10 and communicates with the interior thereof and the slope of the chute is such that golf balls such as indicated by reference character 19, are moved by gravity from the hopper, to the interior of the enclosure.

Situated within the enclosure is an elevator component guide tube 20 and the chute communicates through one side of this guide tube.

An elevator component collectively designated 21 is mounted for reciprocation within said guide tube and incorporates rack teeth 22 on at least one side thereof, said rack teeth being substantially horizontally situated as clearly shown.

The elevator component includes lower end 23 which, when the elevator component is in the lowermost position, rests upon a base plate 24 which is adjustable within limits, by means of adjustment screw 25 extending upwardly through the base 12 of the enclosure.

A golf tee 26 is secured to the upper end 27 of the elevator component by means of a retaining ring 28 which engages over the tee and secures the base 29 to the screw threaded upper end portion 30 of the elevator component.

When the elevator component is in the lowermost position adjusted by means of screw 25, the upper end 26A of the tee is situated adjacent the base of the chute 18 so that a ball can roll by gravity onto the tee and be supported thereby and guided by the guide means 20.

Means are provided to raise the elevator component together with the ball 19, to the uppemost position shown in FIG. 1, said means taking the form of a electric motor 31 mounted within an off-standing portion 32 of the enclosure by means of motor mounting sleeves 33, bolts 34 which engage the motor 31 and nuts 35.

A gear 36 is secured to the drive shaft 37 of the motor and is provided with gear teeth 38 which extend around the periphery of the gear with the exception of a segment indicated by reference character 39 from which the teeth have been removed. The gear teeth engage the rack 22 as clearly shown.

A normally open switch 40 connects the source of electrical energy such as 120 VAC, to the motor 31 which rotates gear 38 and thus raises the elevator component from the lowermost position to the uppermost position shown in FIG. 1 at which time a projection 41 on the gear actuates a normally closed switch 42 and stops the electric motor. It will be observed that the gear which rotates in the direction of arrow 43, is still engaged with the rack although the segment 39 is adjacent the rack at this time.

The player addresses the ball and drives same from the tee 26 and then again actuates switch 40. This causes the gear 36 to continue to rotate in the direction of arrow 43 so that the teeth disengage from the rack as the segment 39 reaches the rack. The elevator component together with the tee 26 drops by gravity onto plate 24 and a further ball is loaded by gravity onto the tee 26. The gear continues to rotate through segment 29 until the beginning 38A of the teeth again engage the rack and cause same to move upwardly to the uppermost position at which time switch 42 is again tripped thus disconnecting the motor so that the ball on the tee is ready for play.

The principal advantage of the present device is that the elevator component is raised by the electric motor but is lowered by gravity thus speeding up the delivery of a ball ready for play.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A golf ball teeing apparatus comprising in combination an enclosure, a gravity fed golf ball supply chute leading into said enclosure, a vertically movable ball elevator component for cyclic movement from a lower position to a raised position, guide means for said elevator component, said elevator component being positioned to be guided vertically by said guide means, a tee mounted in the upper end of said elevator component, means to move said elevator component from the lower ball loading position to a raised tee position, said chute discharging a ball by gravity through said guide means and onto said tee when said elevator component is in said lower ball loading position, a source of power supplied to said means to move said elevator component to raise said elevator component, and activating and deactivating means operatively connected between said source of power and said elevator component for activating and deactivating said means to move when said elevator component is in said raised position, means for causing said elevator component to return to said lower position by gravity.

2. The apparatus according to claim 1 wherein said activating means is a first switch to initiate the raising of said elevator component from the lower ball loading position to the raised tee position and said deactivating means is a further switch cause in parallel with said first switch, to said elevator component to remain in said raised tee position until said first switch is again activated.

3. The apparatus according to claim 2 in which said means to move includes a rack extending along at least one side of said elevator component and a gear driven by said source of power operatively engaging said rack, said gear having a segment of gear teeth removed whereby said rack is disengaged from said gear when said segment reaches said rack.

4. The apparatus according to claim 3 which includes a feed hopper operatively connected to said chute.

5. The apparatus according to claim 1 in which said means to move said elevator component includes a rack extending along at least one side of said elevator component and a gear driven by said source of power operatively engaging said rack.

6. The apparatus according to claim 5 which includes a feed hopper operatively connected to said chute.

7. The apparatus according to claim 1 which includes a feed hopper operatively connected to said chute.

8. An apparatus for raising an elevator component carrying a golf tee on the upper end thereof comprising an electric motor, a gear driven by said electric motor operatively connected thereto, a vertically movable elevator component, a rack provided on at least one side of said elevator component, said gear engaging said rack, a segment of gear teeth being removed from said gear, said electric motor for rotating said gear upon actuation of a first switch means said gear being rotated until said gear teeth engage said rack and raise said elevator component to an upper position when said first switch means is closed, a normally closed second switch means in parallel with said first switch means to open said first switch means and thus deactivate said motor when said elevator component reaches said upper position until said first switch means is again closed; and a golf ball supply chute adapted to supply golf balls by gravity one at a time to said tee, when in the lowermost position, said elevator component returning to said lower position by gravity when said removed segment of gear teeth disengages said gear from said rack.

9. the apparatus according to claim 8 which include an enclosure for said apparatus to raise said elevator component carrying a golf ball and guide means for said elevator component, said chute discharging a ball sequentially by gravity to the said tee when said elevator component is in the lowermost position.

10. The apparatus according to claim 9 which includes a feed hopper operatively connected to said chute.

11. The apparatus according to claim 8 which includes a feed hopper operatively connected to said chute.

12. In a golf ball teeing apparatus which includes an enclosure, a gravity fed golf ball supply chute leading into said enclosure, a vertically movable ball elevator component for movement between raised and lowered positions, and guide means for said elevator component, said chute being adapted to discharge a golf ball onto said elevator component when said elevator component is in a lowermost position; the improvement comprising a rack upon at least one side of said elevator component, a gear engaging said rack, a source of power to rotate said gear, said gear having a segment of teeth removed therefrom, a manually operated, normally open first switch means for actuating said source of power and rotating said gear thereby raising said elevator component to an uppermost position when said switch means is closed, a normally closed second switch means in parallel with said first switch means for opening said first switch and thus deactivating said source of power when said elevator component is in said uppermost position until said first switch means is again closed, said segment with said teeth removed reaching said rack when said first switch means is again closed thereby disconnecting said gear from said rack, said rack falling by gravity to the lowermost position, the teeth commencing at the trailing end of said segment again engaging said rack and raising said elevator component to the uppermost position.

13. The apparatus according to claim 12 which includes a feed hopper operatively connected to said chute.

* * * * *

UNITED STATES PATENT AND TRADEMARK OFFICE

CERTIFICATE OF CORRECTION

PATENT NO. : 4,815,744

DATED : March 28, 1989

INVENTOR(S) : Diamandis Manolis

It is certified that error appears in the above-identified patent and that said Letters Patent is hereby corrected as shown below:

Inventor's name transposed. Should be Diamandis Manolis.

Column 4 line 29. Claim 2 delete "cause".

Column 4 line 30. "to said" should be "to cause said".

Column 4 line 59. "means" should be "means,".

Column 5 line 4. Claim 9 "the" should be "The".

Signed and Sealed this

Twenty-first Day of November, 1989

*Attest:*

JEFFREY M. SAMUELS

*Attesting Officer* *Acting Commissioner of Patents and Trademarks*